US006170126B1

(12) United States Patent
Stahlecker

(10) Patent No.: US 6,170,126 B1
(45) Date of Patent: Jan. 9, 2001

(54) TRANSPORT BELT FOR TRANSPORTING A FIBER STRAND TO BE CONDENSED

(75) Inventor: Hans Stahlecker, Haldenstrasse 20, 73079 Suessen (DE)

(73) Assignees: Fritz Stahlecker, Bad Ueberkingen; Hans Stahlecker, Suessen, both of (DE)

( * ) Notice: Under 35 U.S.C. 154(b), the term of this patent shall be extended for 0 days.

(21) Appl. No.: 09/361,526

(22) Filed: Jul. 27, 1999

(30) Foreign Application Priority Data

Aug. 17, 1998 (DE) ..... 198 37 179

(51) Int. Cl.[7] ..... D01H 5/86

(52) U.S. Cl. ..... 19/246; 19/236; 19/150

(58) Field of Search ..... 19/150, 236, 237, 19/238, 239, 240, 241, 242, 243, 244, 245, 246, 247, 248, 249, 250, 252, 263, 286, 287, 288, 304, 305, 306, 307, 308

(56) References Cited

U.S. PATENT DOCUMENTS

| | | | | |
|---|---|---|---|---|
| 2,659,936 | * | 11/1953 | Sandelin | 19/288 |
| 3,090,081 | * | 5/1963 | Klein | 19/288 |
| 3,122,794 | * | 3/1964 | Klein | 19/288 |
| 3,438,094 | * | 4/1969 | Field, Jr. | 19/288 |
| 5,090,192 | * | 2/1992 | Stahlecker | 57/328 |
| 5,600,872 | | 2/1997 | Artzt et al. . | |

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

A transport belt of a ring spinning machine for transporting a fiber strand to be condensed over a suction slit of a condensing zone is provided with a perforation or perforations for a suction air stream which suctions the fiber strand. The transport belt comprises a nonperforated area which permits a friction drive, and also an effective area containing the perforation, the width of the effective area being larger than the width of the suction slit. For example, the transport belt comprises a skeleton belt forming a supporting structure with a close-meshed woven fabric applied thereto.

13 Claims, 3 Drawing Sheets

17
21
10
11
22
8
4
1
6
A
7
B
18
9
20
II
16
15
3
5
2

16
10
20
9
21
17
4
5
19
13
18
A
7
B
14
12
15
2
1
22
3

TRANSPORT BELT FOR TRANSPORTING A FIBER STRAND TO BE CONDENSED

BACKGROUND AND SUMMARY OF THE INVENTION

This application claims the priority of German application 198 37 179.9, filed Aug. 17, 1998, the disclosure of which is expressly incorporated by reference herein.

The present invention relates to a transport belt for transporting a fiber strand to be condensed over a suction slit of a condensing zone, said belt having a perforation for a suction air stream which sucks the fiber strand.

In U.S. Pat. No. 5,600,872 a transport belt of this type is described, which is designed like a drafting apron, but made of a material which has a greater elastisicity than is usual in the case of drafting aprons. The transport belt comprises centrical holes arranged in travel direction, through which holes the suction air stream enters. The size of the perforations determines to what degree the fiber strand is bundled transversely to the transport direction in the condensing zone. The transport belt is guided during operation over a suction slit, which extends in transport direction and which is essentially wider than the perforation.

The condensing of an already drafted, yet still spinning twist-free fiber strand serves the purpose of rolling outwardly projecting edge fibers around the core strand, so that a better material utilization is permitted and that the fiber strand is less hairy before being imparted a spinning twist. This results in a smoother and more tear resistant yarn.

It has been shown that it is not favorable when the clearance of the perforation holes alone determines the degree of condensing. The diameter of the holes would have to be so large that the air entering though the perforations would become inhomogenous.

It is an object of the present invention to make the condensing effect not exclusively dependant on the clearance of the perforation, but rather to chose a perforation with which a homogenous as possible suction air stream can be achieved.

This object has been achieved in accordance with the present invention in that the transport belt comprises a non-perforated area which permits a friction drive, and an effective area containing the perforation, which effective area is wider than the width of the suction slit.

In contrast to prior art, the clearance of the perforation holes no longer determine the condensing effect, but rather the suction slit located under the transport belt. The width of the suction slit is somewhat wider than the width of the condensed fiber strand. The effective width of the perforation is in contrast significantly wider, namely so wide that the suction slit can, if required, be arranged under the perforation slightly transversely to the transport direction, in order that the fiber strand to be condensed is imparted an additional, slight false twist. In the case of such an embodiment the perforation can be so close-meshed that a completely homogenous suction air stream arises.

The transport belt can consist of a flexible apron looped around a drive roller, which apron comprises a plurality of centrical rows of holes. A thin steel belt of, for example, 0.4 mm thickness can be provided, which comprises a centrical perforation produced by means of etching. Particularly advantageous is, however, a skeleton type supporting structure for a transport belt, on which only a very thin perforated tape is applied in the central area. This centrical placed perforated tape can consist of a particularly thin and close-meshed woven or knitted fabric.

In a variation of the embodiment according to the present invention, the perforated tape is welded or adhered to the skeleton-like supporting structure. Alternatively, the perforated tape can be applied to the skeleton belt in an interchangeable way.

It is important that the perforation is as closely meshed as possible, while on the other hand the perforated area should be significantly wider than the fiber strand to be condensed. The perforation serves only for the generating of a suction air stream, which effects the pneumatic condensing. The degree of condensing is however determined by the suction slit located under the transport belt.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
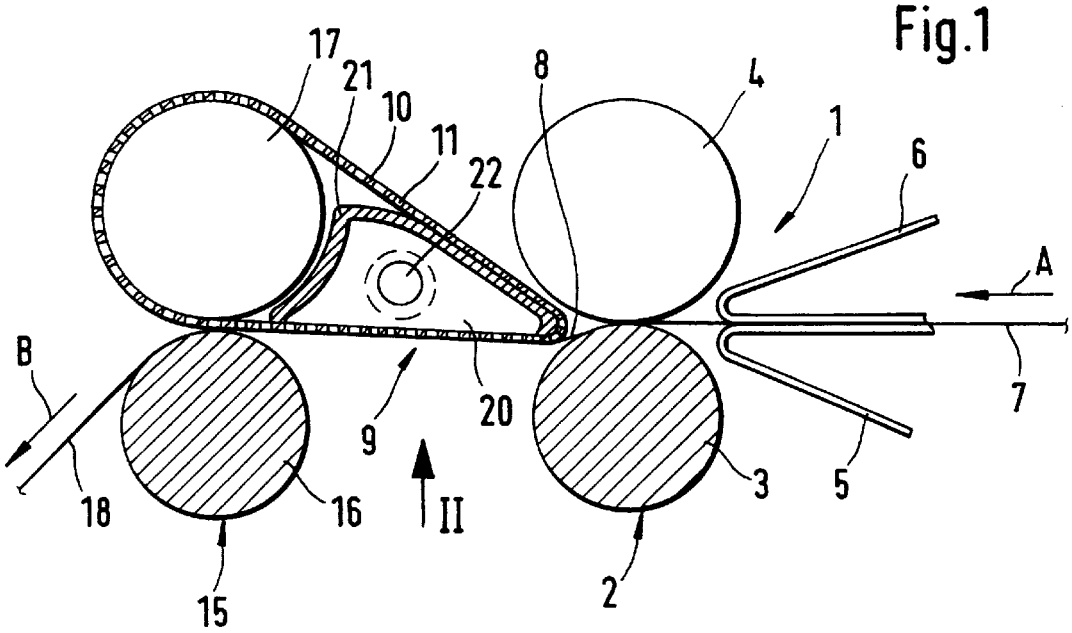
FIG. 1 is a part sectional side view of a transport belt according to the present invention.
Figure 2:
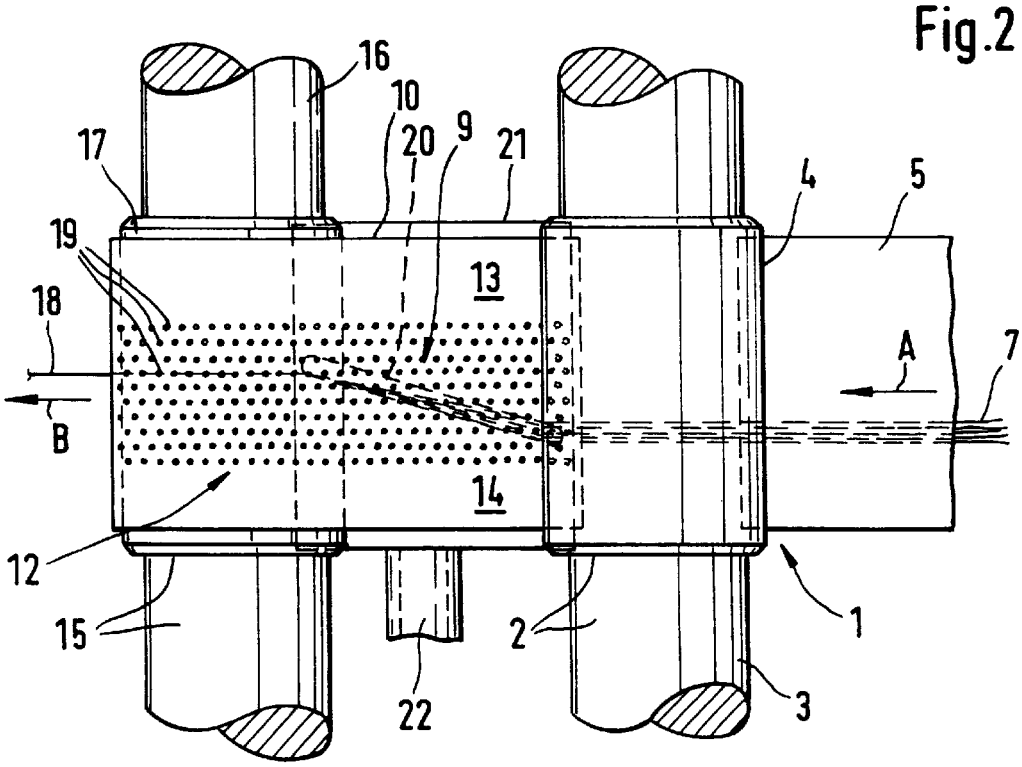
FIG. 2 is a view in direction of arrow II onto FIG. 1.

In the embodiment of the present invention according to FIGS. 1 and 2, only the area of a front roller pair 2 of a drafting assembly 1 of a ring spinning machine is shown. The front roller pair 2 comprises in a known way a driven bottom cylinder 3 which extends in machine longitudinal direction, on which bottom cylinder 3 one top roller 4 per spinning station is flexibly pressed. Further, an apron pair of the drafting assembly 1 can be recognized, which apron pair is arranged upstream of the front roller pair 2, and which apron pair consists of a bottom apron 5 and an upper apron 6.

In the drafting assembly 1 a sliver or roving 7 is drafted in transport direction A to the desired degree of fineness. Downstream of the front roller pair 2 a finished drafted apart from a slight subsequent draft-fiber strand 8 exists, which is guided through a condensing zone 9. In the condensing zone 9, still outwardly projecting edge fibers are to be rolled around the core strand under a light tension draft, so that the fiber strand 8 is bundled, becomes less hairy and is overall smoother and more tear resistant after a spinning twist has been imparted.

A transport belt 10 serves to transport the fiber strand 8 through the condensing zone 9, which transport belt 10 is provided centrically with a perforation 11. The perforation 11 serves to suction the fiber strand 8 to the transport belt 10 by means of a suction air stream.

The perforation 11 is limited to a centrical effective area 12 of the transport belt 10. This effective area 12 is laterally defined by a non-perforated area 13,14, which has an exclusively reinforcing function and which supports the friction drive of the transport belt 10.

A delivery roller pair 15 ends the condensing zone 9 on its exit side, which delivery roller pair 15 comprises a driven bottom roller 16 and a top roller 17 pressed thereon. The top roller 17 is driven by the bottom roller 16 and drives in turn the transport belt 10 which is looped around the top roller 17 by means of friction.

The delivery roller-pair 15 forms a twist block to the onset of spinning twist in the yarn 18 to be spun, which yarn 18 is guided in delivery direction B to a ring spindle. The condensing zone 9 is thus free of any spinning twist and is essentially free of draft.

The transport belt 10 comprises in its effective area 12 a plurality of centrical rows 19 of holes, whereby the effective area 12 is in its entirety so wide, that a suction slit 20 located thereunder is completely covered. The fiber strand 8 is transported by means of the transport belt 10 over the suction slit 20, which is disposed slightly transversely to the transport direction A. The suction slit 20 is itself somewhat wider than the finished drafted fiber strand 8.

The transport belt 10 slides between the front roller pair 2 and the delivery roller pair 15 over a hollow profile 21 of the suction device. The suction slit 20, disposed slightly transversely, is directed towards the transport belt 10, so that under the effect of the inclination of the suction slit 20 and the transport direction of the transport belt 10, the fiber strand 8 is imparted a slight false twist during condensing.

The hollow profile 21 is connected to a suction supply 22, which leads to a vacuum source (not shown).

Deviating from the above described prior art, the diameter of the holes of the perforation 12 no longer determines the degree of condensing, but rather the position and the dimensions of the suction slit 20 do. The perforation 12 should be as close-meshed as possible and ensure a homogenous suction air stream.

In the Figures described below the same reference numbers will be used as before, insofar as components having identical functions are involved. A repeat description is therefore omitted.

Figure 3:
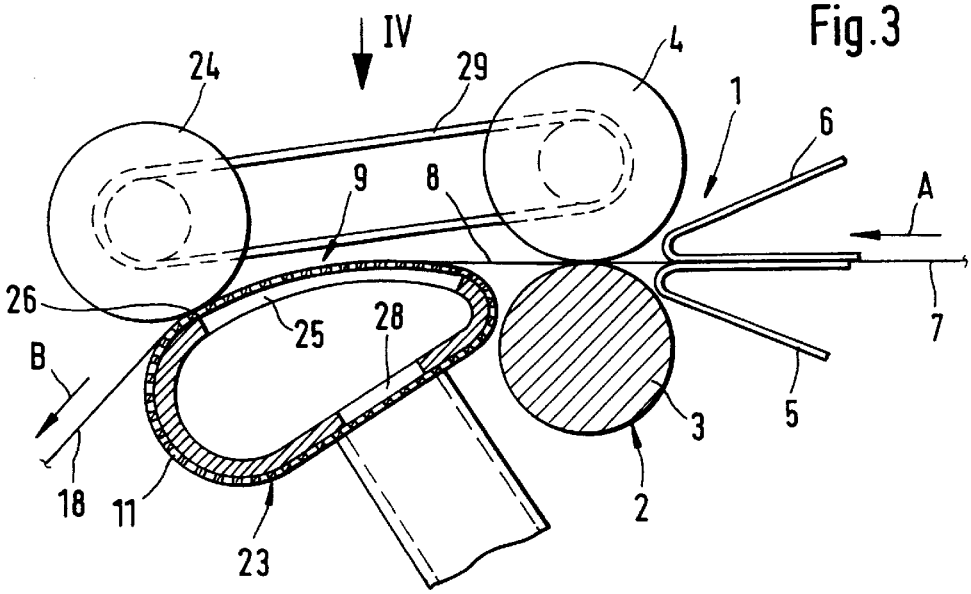
FIG. 3 is a schematic sectional view of another embodiment of a transport belt according to the present invention, the design of said transport belt permitting the extension of the suction slit up to a twist block limiting the spinning twist.
Figure 4:
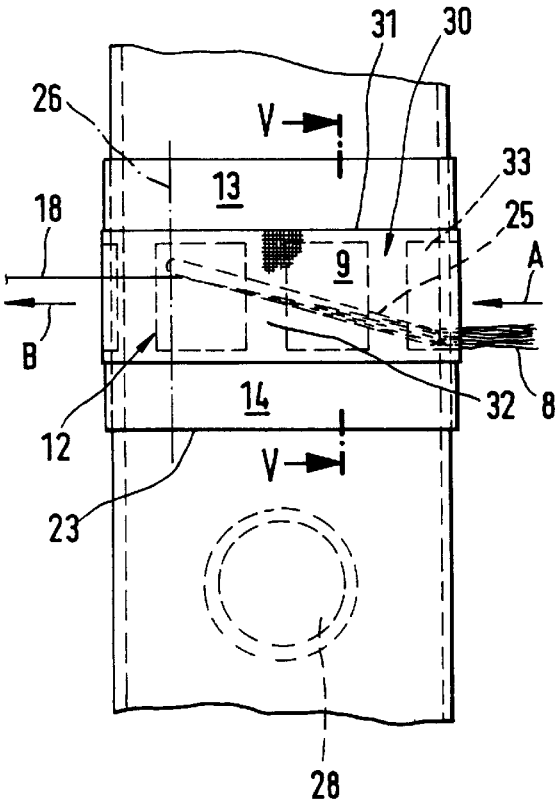
FIG. 4 is a view in the direction of arrow IV of FIG. 3 onto the condensing zone.

The embodiment of the present invention according to FIGS. 3 and 4 differs from the previous design essentially in that now a transport belt 23 is provided, which is no longer looped around a transport roller. In place of the delivery roller pair 15 as shown in FIGS. 1 and 2, a nipping roller 24 is provided in the embodiment according to FIGS. 3-and 4. The transport belt 23 runs around a hollow profile 21, which may extend over a plurality of spinning stations. The outer contour of the hollow profile 21 is in the form of a sliding surface for the transport belt 23. The nipping roller 24 presses the fiber strand 8 to be condensed against the transport belt 23 and this in turn on the hollow profile 21, which is part of a suction device. The pressure of the nipping roller 24 is effected along a nipping line 26, which here also is effective as a twist block against the spinning twist in the yarn 18.

The condensing zone 9 is located now between the front roller pair 2 of the drafting assembly 1 and the nipping line 26. This design has the advantage that the suction slit 25 applied to the hollow profile 21 can now be guided up to the nipping line 26. The transport belt 23 itself is driven by means of friction by the nipping roller 24, which in turn is driven by means of a drive belt 29 by the top roller 4.

In the embodiment according to the present invention as shown in FIGS. 3 and 4, the perforation 11 is provided only over an effective area 12 in the centrical area of the transport belt 23. The width of the effective area 12 is so chosen, that it completely covers the suction slit 25. Thus the diagonal, the width and the length of the suction slit 25 determine here also the condensing effect, while the perforation 11 of the transport belt 23 primarily ensures as homogenous a suction air stream as possible.

Figure 5:
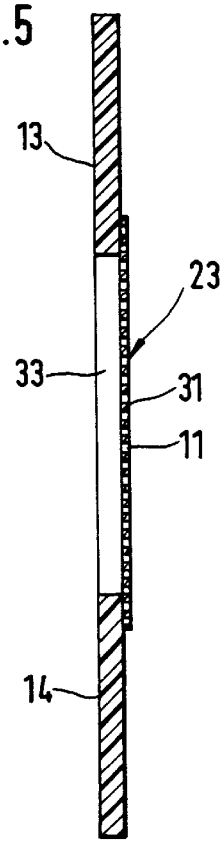
FIG. 5 is a sectional view along the sectional surface V—V of FIG. 4 through a greatly enlarged transport belt according to the present invention.

The transport belt 23 has, as can be seen in particular in the enlarged representation in FIG. 5, a skeleton-like supporting structure 30, on which a thin perforated tape 31 is applied centrically by means of welding or adhering. This perforated tape 31 is made for the purpose from a close-meshed woven or knitted fabric, preferably very thin polyamide filaments. The perforated tape 31 can thus be applied to the non-perforated areas 13 and 14 of a more stable supporting structure.

In order that the perforation 11 of the perforated tape 31 is completely effective, the supporting part of the transport belt 23 is provided with very wide longitudinal slits 33, which are broken by cross-pieces 32 for the purpose of reinforcement.

Figure 6:
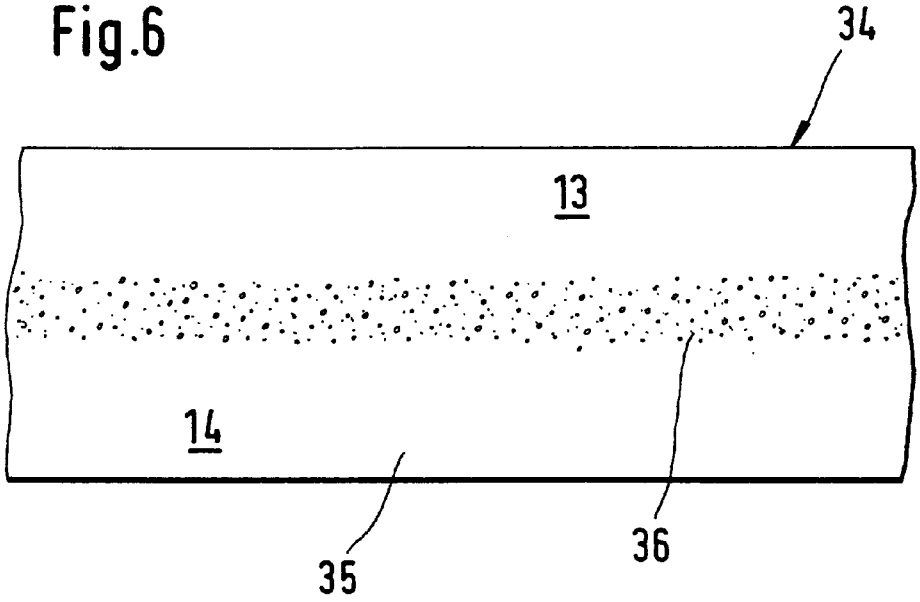
FIG. 6 is a view onto a transport belt in the form of a steel belt having centrical perforations produced by etching.

In a variation of the present invention shown in FIG. 6, a transport belt 34 is provided, which takes the form of a very thin steel belt 35. The thickness of the steel belt 35 can measure, for example, 0,4 mm. The steel belt 35 comprises a centrical perforation 36, which is produced by etching. The edges of the transport belt 34 comprise again each a non-perforated area 13,14.

Figure 7:
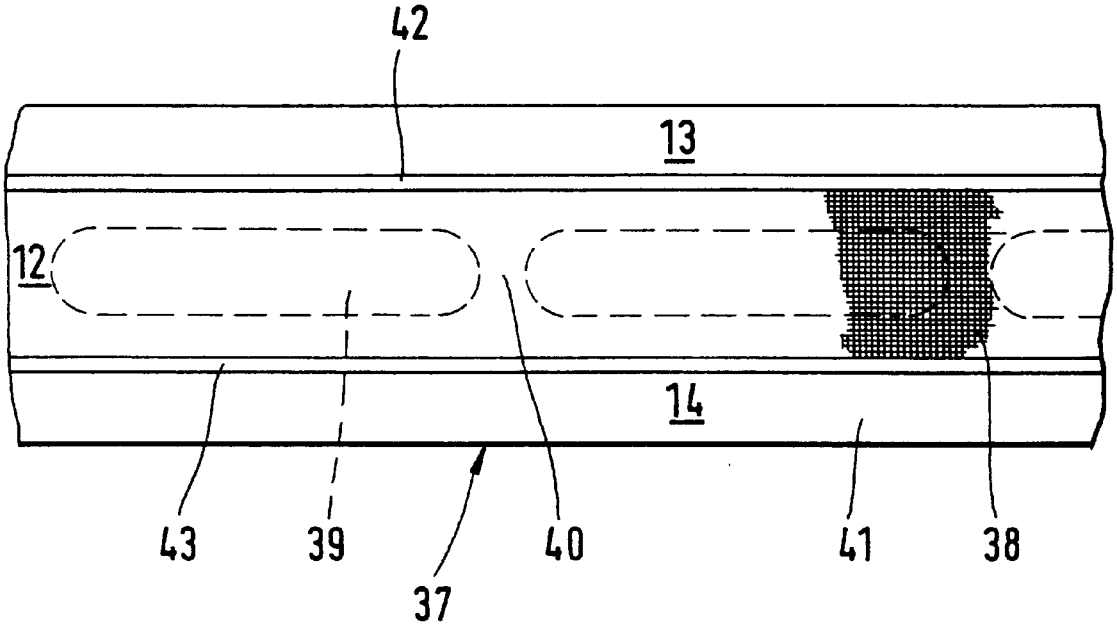
FIG. 7 is a view onto a so-called skeleton belt, which serves as a supporting structure for a close-meshed woven sieve belt.

In a particularly advantageous embodiment of the present invention as shown in FIG. 7, a transport belt 37 is provided, which has a non-perforated area 13,14 at the edges and an effective area 12 in a central area, the effective area 12 comprising a perforation 11. The transport belt 37 is produced as a so-called skeleton belt 41, which has primarily a supporting function and which furthermore serves the friction drive. This skeleton belt 41 is provided in the central area with a plurality of longitudinal slits 39 arranged one after the other in a row, and which are broken by cross-pieces 40.

A thin, close-meshed woven fabric 38 of polyamide filaments is secured to the skeleton belt 41 in an exchangeable way. The exchangeability can be achieved in that the woven fabric 38 comprises coated edge zones 42 and 43, with which the woven fabric 38 can be sealed or secured in some other way onto the skeleton belt 41 which is adapted to receive these coatings. The strength of the seal need only be such that the woven fabric 38 can be transported with the skeleton belt 41 during operation. The woven fabric 38, when it is worn down, can be easily removed from the skeleton belt 41 to be replaced by a new one.

The perforation 11 of the woven fabric 38 is located to a great extent in the area of the longitudinal slits 39, which are completely covered by the woven fabric 38. It has been shown, that the cross-pieces 40 do not impair the quality of the yarn in any way.

Here also the width of the effective area 12 is chosen that the suction slit, located under the transport belt 37, is completely covered. The very close-meshed, thin woven fabric 38 permits a particularly homogenous suction air stream, while the condensing effect is determined by the position and the arrangement of the suction slit 20 or 25.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transport belt for transporting a fiber strand to be condensed over a suction slit of a condensing zone, said belt having a perforation for a suction air stream which suctions the fiber strand, wherein the transport belt comprises a non-perforated area which permits a friction drive, and an effective area containing the perforation, the width of which effective area is larger than the width of the suction slit.

2. A transport belt according to claim 1, wherein the transport belt is a flexible apron looped around a drive roller, said apron having holes arranged in a plurality of centrical row.

3. A transport belt according to claim 1, wherein the transport belt is a thin steel belt having a centrical perforation.

4. A transport belt according to claim 1, wherein the transport belt has a skeleton-like supporting structure, on which a thin perforated tape is applied centrically.

5. A transport belt according to claim 4, wherein the perforated tape is welded or adhered on.

6. A transport belt according to claim 5, wherein the perforated tape is made of a woven or knitted fabric.

7. A transport belt according to claim 4, wherein the perforated tape is applied in an exchangeable way.

8. A transport belt according to claim 6, wherein the perforated tape is made of a woven or knitted fabric.

9. A transport belt according to claim 4, wherein the perforated tape is made of a woven or knitted fabric.

10. A transport belt according to claim 4, wherein the supporting structure is a skeleton belt which is provided with wide longitudinal slits, broken by cross-pieces.

11. A transport belt according to claim 10, wherein the perforated tape is welded or adhered on.

12. A transport belt according to claim 10, wherein the is perforated tape is applied in an exchangeable way.

13. A transport belt according to claim 10, wherein the perforated tape is made of a woven or knitted fabric.

* * * * *